US005537795A

United States Patent [19]

Dias

[11] Patent Number: 5,537,795

[45] Date of Patent: Jul. 23, 1996

[54] HINGE AND RAIL CONNECTION SYSTEM

[75] Inventor: Gary R. Dias, Folsom, Calif.

[73] Assignee: California Prison Industry Authority, Folsom, Calif.

[21] Appl. No.: 186,755

[22] Filed: Jan. 24, 1994

[51] Int. Cl.[6] ..... E04B 2/74; F16B 1/00

[52] U.S. Cl. ..... 52/586.2; 52/36.1; 52/71; 52/282.1; 52/582.1; 160/135

[58] Field of Search ..... 52/71, 36.1, 277, 52/282.1, 464, 468, 582.1, 584.1, 586.1, 586.2; 160/135

[56] References Cited

U.S. PATENT DOCUMENTS

| | | | |
|---|---|---|---|
| 3,019,486 | 2/1962 | Stinson . | |
| 3,460,860 | 8/1969 | Stevens, Jr. | 52/71 |
| 3,512,819 | 5/1970 | Morgan et al. | 52/586.1 X |
| 3,517,467 | 6/1970 | Propst et al. . | |
| 3,713,257 | 1/1973 | Beavers . | |
| 3,862,524 | 1/1975 | McCrackin . | |
| 3,990,204 | 11/1976 | Haworth et al. . | |
| 4,011,706 | 3/1977 | Düpree . | |
| 4,084,366 | 4/1978 | Saylor et al. . | |
| 4,084,367 | 4/1978 | Saylor et al. . | |
| 4,144,924 | 3/1979 | Vanden Hoek | 160/135 X |
| 4,199,206 | 4/1980 | Haworth et al. . | |
| 4,213,493 | 7/1980 | Haworth . | |
| 4,241,965 | 12/1980 | Wilson et al. . | |
| 4,277,123 | 7/1981 | Haworth et al. . | |
| 4,344,475 | 8/1982 | Frey . | |
| 4,356,672 | 11/1982 | Beckman et al. . | |
| 4,367,370 | 1/1983 | Wilson et al. . | |
| 4,370,008 | 1/1983 | Haworth et al. . | |
| 4,377,724 | 3/1983 | Wilson . | |
| 4,596,098 | 6/1986 | Finkbeiner et al. . | |
| 4,601,137 | 7/1986 | Bates . | |
| 4,638,606 | 1/1987 | Wendt . | |
| 4,666,223 | 5/1987 | Tillmann . | |
| 4,703,985 | 11/1987 | Finkbeiner et al. . | |
| 4,731,960 | 3/1988 | Sease . | |
| 4,881,349 | 11/1989 | Brown et al. | 52/584.1 X |
| 4,962,805 | 10/1990 | Allen . | |
| 4,979,554 | 12/1990 | Nelson . | |
| 4,993,205 | 2/1991 | Dull et al. . | |
| 4,996,811 | 3/1991 | Dull et al. . | |
| 5,033,526 | 7/1991 | DeLong et al. . | |
| 5,054,255 | 10/1991 | Maninfior . | |
| 5,092,385 | 3/1992 | Beaulieu . | |

FOREIGN PATENT DOCUMENTS

| | | |
|---|---|---|
| 1249410 | 1/1989 | Canada . |
| 0292833 | 11/1988 | European Pat. Off. . |
| 0342566 | 11/1989 | European Pat. Off. . |
| 2629500 | 10/1989 | France . |

OTHER PUBLICATIONS

Haworth; "Haworth Installation Procedures"; 1982; Haworth, Inc.

"System XXI —Instructions"; Undated.

*Primary Examiner*—Carl D. Friedman
*Assistant Examiner*—Kevin D. Wilkens
*Attorney, Agent, or Firm*—John P. O'Banion

[57] ABSTRACT

A hinge and rail connection system for joining wall panels. The system includes a flexible hinge and a rail assembly, the flexible hinge having channels for receiving complementary flanges on rails which are coupled to the wall panels. The hinge includes a pair of pivotal hinge members which can be articulated about a vertical axis at any selective angular relationship to form office partitions having a near infinite variety of shapes and layouts. Additionally, the design of the connection system provide enhanced aesthetics by eliminating the mechanical appearance of hang-on support bracket slots located in the rails.

10 Claims, 7 Drawing Sheets

HINGE AND RAIL CONNECTION SYSTEM

BACKGROUND OF THE INVENTION

1. Field of the Invention

This invention pertains generally to devices for connecting modular wall panels, and more particularly to a hinge and rail connection system employing a flexible hinge having elongated articulating rail couplings with longitudinal channels therebetween which engage rails having longitudinal rails that curve outward to form flanges that reversibly engage the longitudinal channels of the rail couplings, thereby providing for facile, flexible, and reversible attachment of panels or components in a manner that is aesthetically pleasant and compatible with the panels.

2. Description of the Background Art

Wall structures formed from a plurality of prefabricated interconnected and portable panels are used extensively in commercial and industrial buildings for dividing interior regions into smaller work regions. Such structures have proven particularly effective in providing greater privacy within the building, while at the same time improving the interior appearance. For this purpose, the panels are provided with many different exterior finishes, such as colored plastics, carpets and fabrics. Many panels of this type are also provided with slotted hang-on rails extending vertically along the edges thereof, whereupon fixtures such as work surface tops, shelves, filing cabinets and the like can be mounted on the panels.

Many of these panels, however, also tend to look mechanical in appearance due to the connection system used to joint the panels. Typical connection systems use an L-shaped or T-shaped hinge which slides into a complementary shaped receptacle in the panel vertical hang-on rail. These panel systems tend to contribute to a mechanical appearance due to the easily viewed slots in the hang-on rail. Some systems, in an attempt to cover up the slots, employ an additional mechanical device or paper or tape product to block the slots until used by a hang-on component. Further some systems that utilize a plastic hinge will also visually create the exterior look of three individual strips at the connecting point while exposing the hang-on rail slots creating an obtrusive mechanical appearance.

For example, U.S. Pat. No. 4,084,366 discloses a sound absorbing system involving wall panels having panel end caps with grooves for receiving a flexible hinge. Adjacent panels are attached by engaging the flexible hinge in the end cap grooves.

U.S. Pat. No. 3,990,204 discloses an alignment system for wall panels. Panel end caps are used with interlocking rails to join panels end to end.

Canadian Patent No. 1,249,410 discloses a panel partitioning system having "L" shaped snap fit connectors with a central pivot. The snap fit connectors attach to end plates on the panels.

French Patent No. 2,629,500 discloses a modular partition designed for use in dust free environments. Panel ends have vertical recesses of rectangular cross section, which join by snapping over a tubular post with square cross section, rounded corners, and concave sides.

U.S. Pat. No. 4,344,475 discloses an office partition interconnector assembly having a generally flat connecting strip with beaded edges which fit into channels on the ends of the panels.

U.S. Pat. No. 5,092,385 discloses an interlocking panel system. Panel connectors having flared ribs engage slots in adjacent panels, and a locking mechanism prevents removal of the connectors from the slots.

U.S. Pat. No. 4,356,672 discloses a partitioning system with connecting wall panels that use compression fittings and snap connectors.

U.S. Pat. No. 4,638,606 discloses a decorative trim system for partitions adapted to support a cantilevered load. This connection system involves a connector using splines and studs.

As can be seen, therefore, a variety of connecting systems have been devised for use with wall panels, office partitions, display booths, and the like. Because of the temporary nature of wall panel and partition systems, however, they are frequently unattractive and provide work environments that are unaesthetic. Particularly, many connecting systems have an obtrusive mechanical appearance or allow undesirable visual access through the connecting system.

Therefore, there is a need for a wall panel connection system which is easy to install, which provides for secure interconnection of wall panels, and which provides improved aesthetic appearance over conventional systems. The present invention satisfies that need, as well as others, and overcomes the deficiencies found in prior attachment systems.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention pertains to a hinge and rail connection system for panels and modular components and generally comprises a flexible hinge, an elongated rail, and means for attaching the rail to panel and component surfaces. By way of example, and not of limitation, the flexible hinge includes two elongated rail couplings, each rail coupling having first, second, third, and fourth sides, with the rail couplings being flexibly connected to each other by a flexible hinge strip at the corners formed by the first and second sides. A first longitudinal channel runs along the length of the third side of each rail coupling, and a second longitudinal channel runs along the length of the fourth side of each rail coupling, with the second longitudinal channel curving towards the first surface thereby forming a generally L-shaped channel. The rail assembly has first and second edges, a face, and two outer longitudinal rails associated with the face near the first and second edges respectively, the outer longitudinal rails being generally perpendicular to face of the rail assembly. The outer longitudinal rails each curve outward to form outer rail flanges, the outer rail flanges pointing outward toward the rail assembly first and second edges and generally parallel with the face of the rail assembly. A pair of inner longitudinal rails is associated with the face of the rail assembly, located in between and parallel to the two outer rails. The inner longitudinal rails each curve to form inner rail flanges, the inner rail flanges pointing outward towards the first and second edges and generally parallel to the outer rail flanges.

To achieve a connection with the hinge and rail system, the first and second longitudinal channels of the elongated rail coupling of a flexible hinge respectively engage an adjacent inner rail flange and outer rail flange of an elongated rail in a mating configuration. By engaging the inner and outer rail flanges of various elongated rails into the first and second longitudinal channels respectively of the elongated rail couplings of various flexible hinges, a variety of hinge and rail connecting configurations can thereby be achieved.

An object of the invention is to provide a hinge and rail connection system for panels and modular components that is visually and aesthetically pleasing.

Another object of the invention is to provide a hinge and rail connecting system for panels and modular components that is flexible and allows facile attachment of panels and components in several configurations.

Another object of the invention is to provide a hinge and rail connection system that allows for facile attachment of panels and modular components in a reversible manner so that the panels and components can be reconfigured in new arrangements.

Another object of the invention is to provide a hinge and rail system that is easy to install and remove.

Another object of the invention is to provide a hinge and rail system that securely attaches wall panels.

Accordingly, the present invention offers a major aesthetic advantage over panel connection systems heretofore developed. When the present invention is used to connect two or more panels together, only one smooth bar or strip is shown on the exterior which provides an aesthetic advantage over other designs. Additionally, the portion of the hinge member which conceals the front of the hang-on rail system can be color coordinated with the trim color of the panel system.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is embodied in the apparatus which is generally shown in FIG. 1 through FIG. 14. It will be appreciated that the apparatus may vary as to configuration and as to details of the parts without departing from the basic concepts as disclosed herein.

Figure 1:
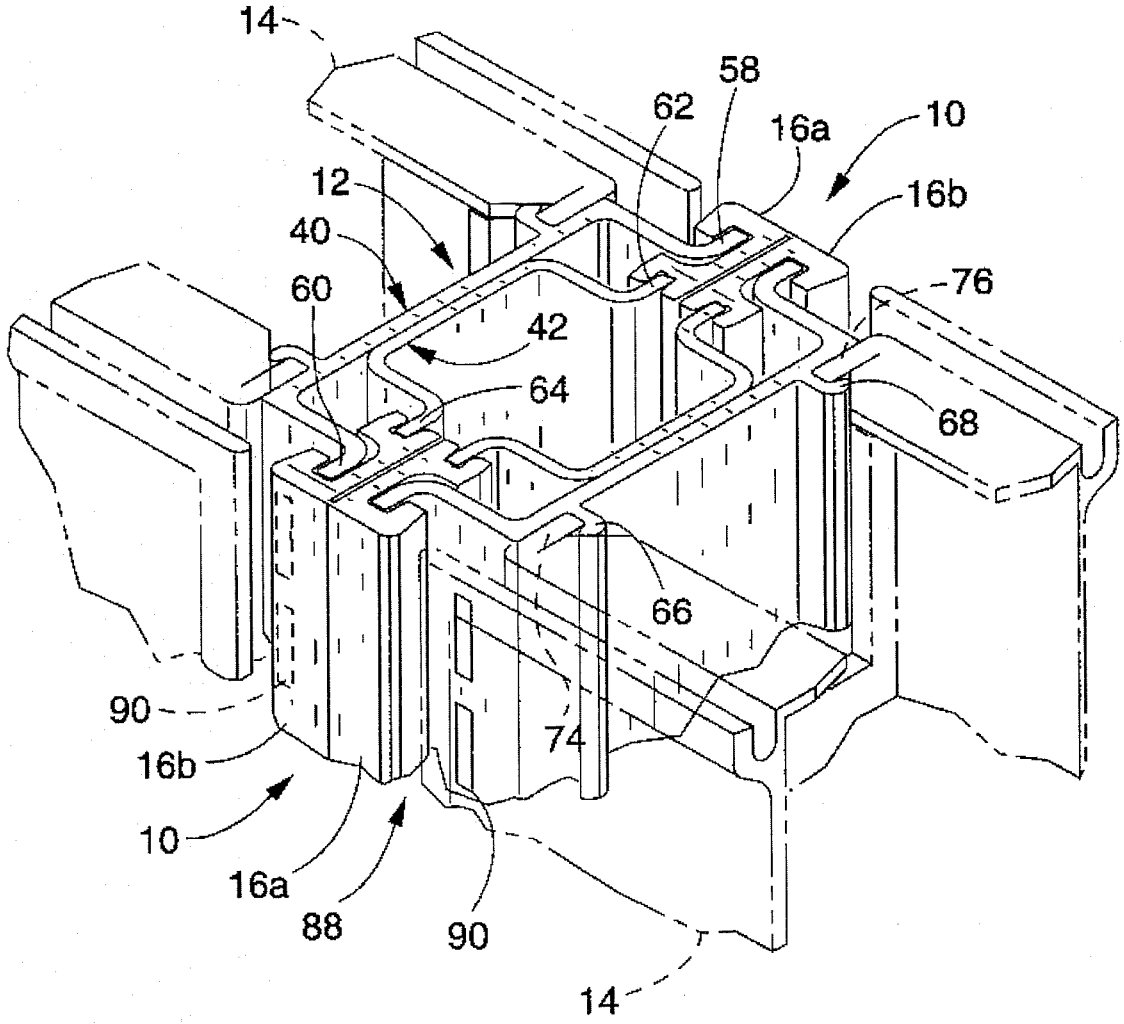
FIG. 1 is a perspective view showing the present invention connecting the ends of two wall panels depicted in phantom in a straight line configuration.
Figure 2:
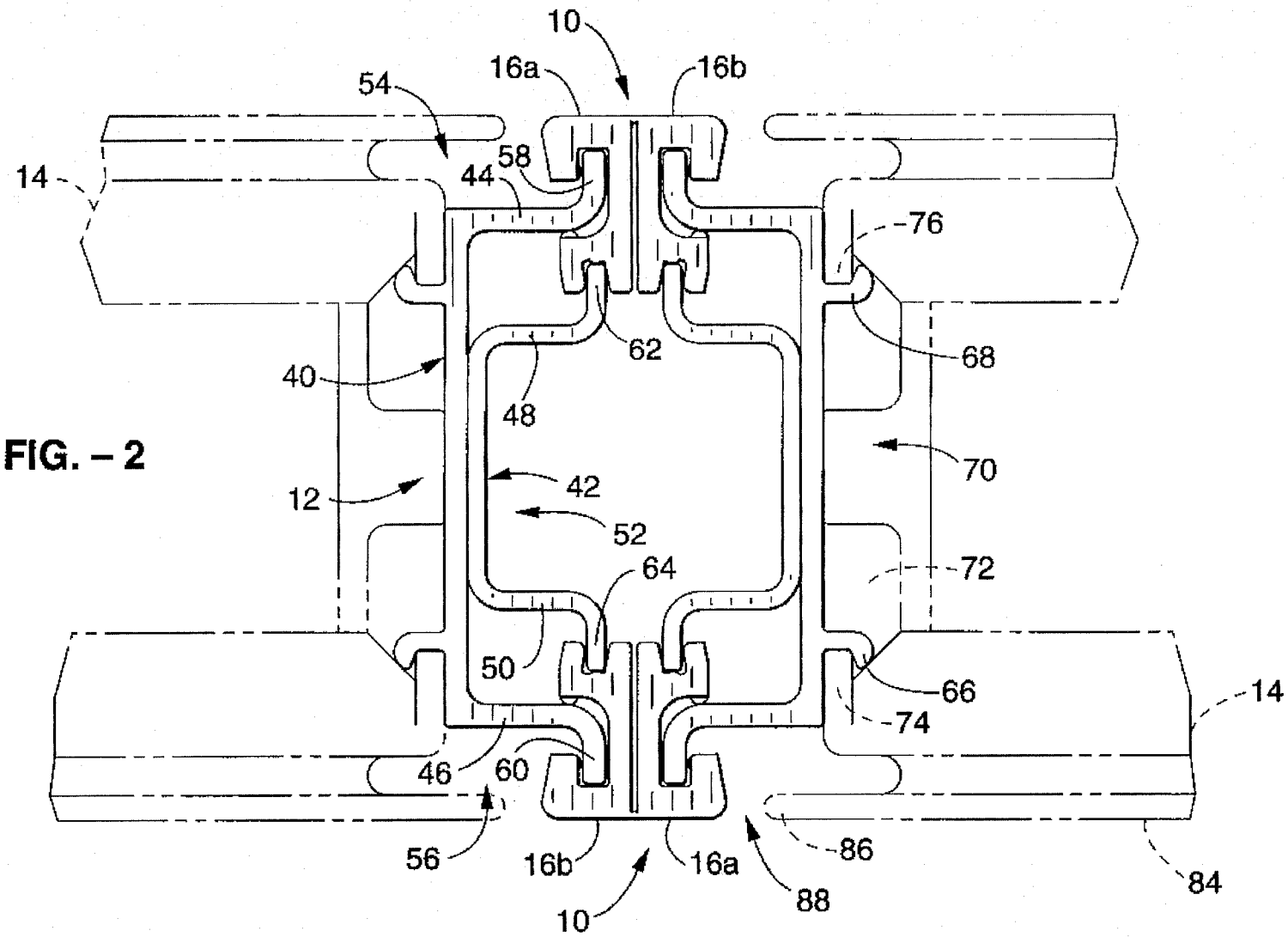
FIG. 2 is a plan view of the wall panel connection shown in FIG. 1.

Referring first to FIG. 1 and FIG. 2, a hinge and rail connection system in accordance with the present invention is shown joining two panel components in a straight-line configuration. In this configuration, two flexible hinges 10 engage two elongated rail assemblies 12 which are in turn coupled to the ends of wall panels 14.

Referring also to FIG. 3 through FIG. 7, in the preferred embodiment, hinge member 10 includes a pair of elongated rail couplings 16*a*, 16*b* which are symmetrical in shape and oriented substantially parallel to each other. Each said rail coupling has a generally planar first side 18, a generally planar second side 20 which is oriented substantially perpendicular to first side 18, a third side 22 which is oriented substantially perpendicular to second side 20 and substantially parallel to first side 18, and a fourth side 24 oriented substantially perpendicular to third side 22 and substantially parallel to second side 20. Rail couplings 16*a*, 16*b* are pivotally joined at their first sides 18, along the edge formed by the juncture of their first sides 18 and second sides 20, by a flexible hinge strip 26 which extends between each end of the rail couplings. In this way, rail couplings 16*a*, 16*b* can articulate at the joint formed by hinge strip 26.

Extending along third side 22 of each rail coupling between each end is a recessed first longitudinal channel 28. Extending along fourth side 24 of each rail coupling between each end is a second recessed longitudinal channel 30 which is oriented substantially parallel to first channel 28. Additionally, second channel 30 is arcuate and curves toward first side 18 to form a substantially L-shaped channel. Preferably, fourth side 24 includes a bevel 32 at the corner intersecting with third side 22. Traction means are provided in the first and second channels 28 and 30, respectively, preferably in the form of longitudinal ridges 34 extending the length of the channels, said ridges preferably having tapered ends 36. In addition, second channel 30 preferably has a longitudinal ridge adjacent to the fourth side 24, thereby forming a lip 38 extending the length of the channel along fourth side 24 adjacent to second channel 30. Other traction means, such as grooves, steps, bumps, or perforations are also contemplated.

Figure 3:
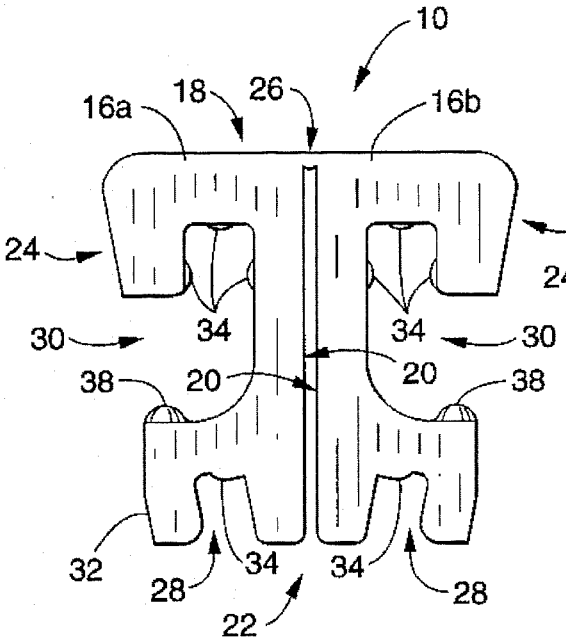
FIG. 3 is an end view of the flexible hinge of the present invention.
Figure 4:
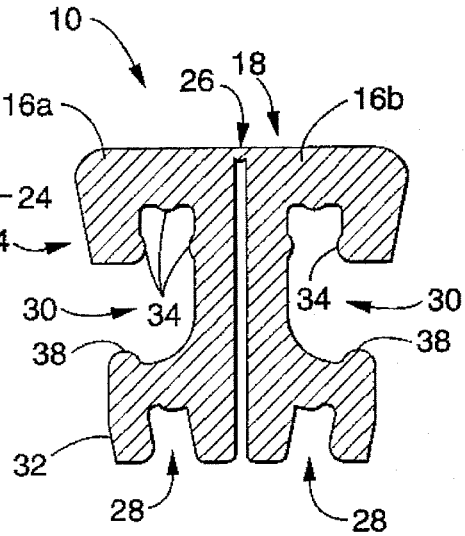
FIG. 4 is a cross-section view of the flexible hinge of the present invention taken through line 4—4.
Figure 5:
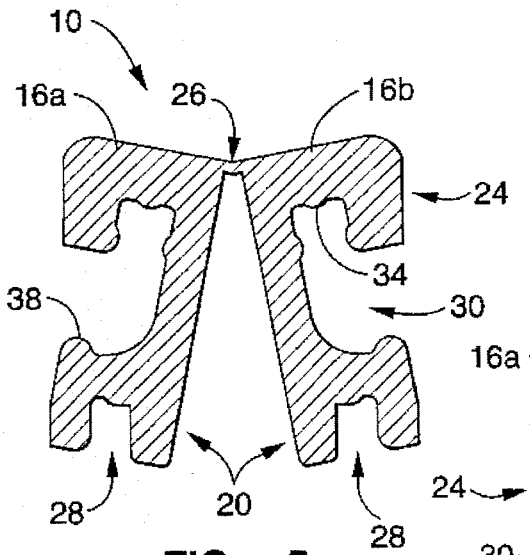
FIG. 5 is a diagrammatic view of the flexible hinge of the present invention in cross-section showing the hinge in a partially flexed position.
Figure 6:
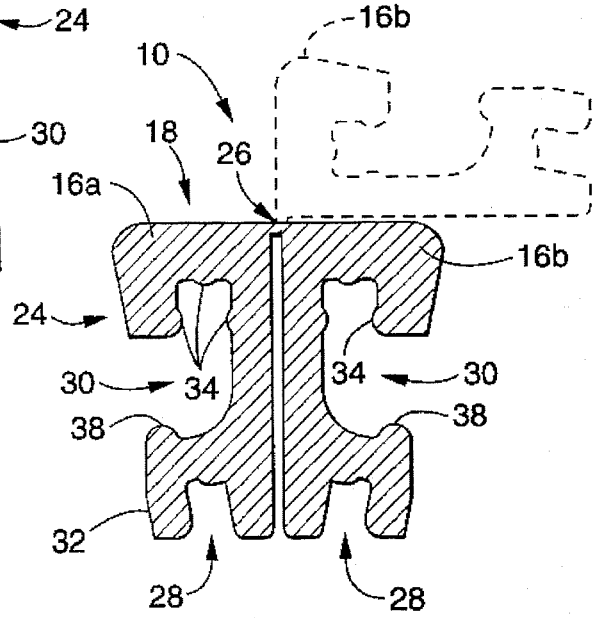
FIG. 6 is a diagrammatic view of the flexible hinge of the present invention in cross-section showing the range of flexation.
Figure 7:
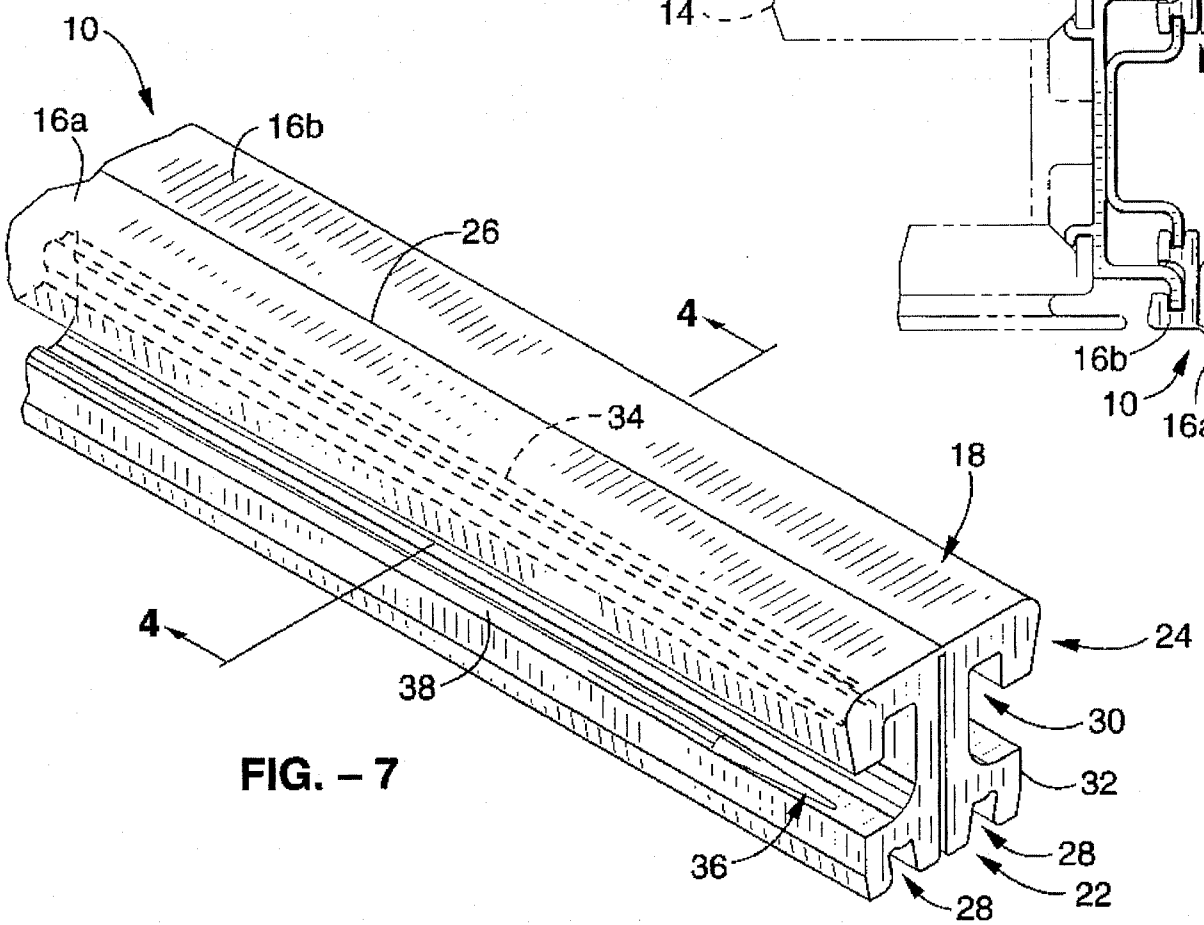
FIG. 7 is perspective view of the flexible hinge of the present invention.

FIG. 3, FIG. 4, and FIG. 7 show a flexible hinge 10 in its closed position where there is no articulation between hinge couplings 16*a*, 16*b*. FIG. 5 shows a flexible hinge 10 with hinge couplings 16*a*, 16*b* opened to approximately twenty-two degrees of articulation, the angle preferably imparted to the flexible hinge as molded. In that way, minimal stress is placed on hinge joint 26 when articulated to a full open position as shown in FIG. 6 which shows the range of movement of a flexible hinge from fully closed to fully open at approximately ninety-degrees.

Figure 8:
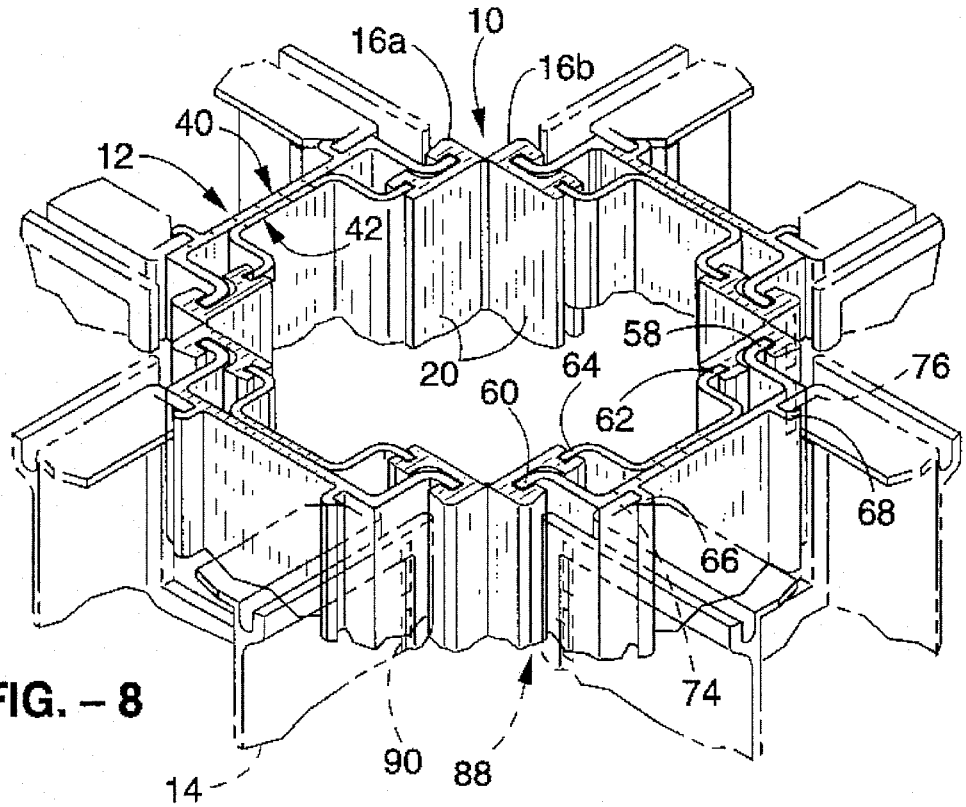
FIG. 8 is a perspective view showing the present invention connecting the ends of four wall panels depicted in phantom in a cross-shaped configuration.
Figure 9:
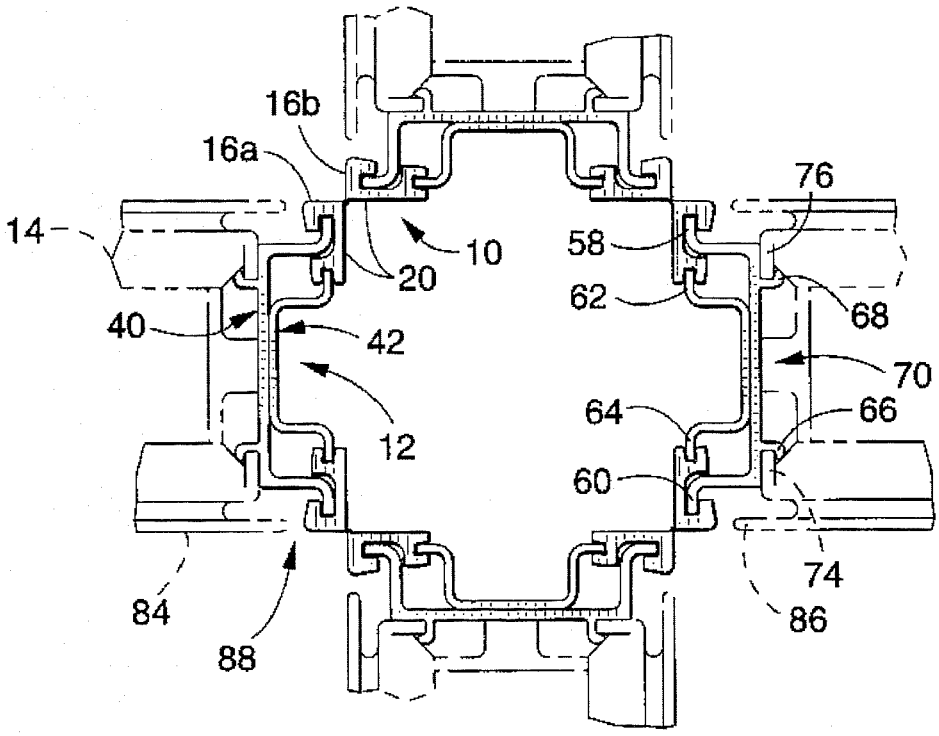
FIG. 9 is a plan view of the wall panel connection shown in FIG. 8.

Referring again to FIG. 1 and FIG. 2, as well as to FIG. 8 and FIG. 9, rail assembly 12 includes elongated first and second rail members 40, 42. First rail member 40 includes elongated symmetrical first and second outer rails 44, 46, and second rail member 42 includes elongated symmetrical first and second inner rails 48, 50. First and second outer rails 44, 46 are generally parallel to each other and generally perpendicular to the face 52 of rail assembly 12. Additionally, first outer rail 44 curves outward toward first edge 54 of rail assembly 12 approximately ninety-degrees to form a first outer rail flange 58. Likewise, second outer rail 46 curves outward toward second edge 56 of rail assembly 12 approximately ninety-degrees to form a second outer rail flange 60. As can be seen, therefore, first and second outer rail flanges 58, 60 are generally parallel to face 52, thereby making first and second outer rails 44, 46 generally L-shaped.

First and second inner rails 48, 50 are disposed between first and S second outer rails 44, 46 and are generally parallel thereto. First and second inner rails 48, 50 are also generally parallel to each other and generally perpendicular to the face 52 of rail assembly 12. Additionally, first inner rail 48 curves outward toward first edge 54 of rail assembly 12 approximately ninety-degrees to form a first inner rail flange 62. Likewise, second inner rail 50 curves outward toward second edge 56 of rail assembly 12 approximately ninety-degrees to form a second inner rail flange 64. As can be seen, therefore, first and second inner rail flanges 62, 64 are generally parallel to face 52, thereby making first and second inner rails 48, 50 generally L-shaped.

For ease of construction, first and second rail members 40, 42 can be fabricated as separate U-shaped pieces, which are then fastened together using conventional fasteners such as welding, bolts, screws, adhesives or the like. It is also contemplated that first and second rail members 40, 42 be fabricated as a contiguous part to form rail assembly 12 by molding or extrusion.

Preferably, the means for attaching rail assembly 12 to the end of a wall panel 14 comprises a pair of outwardly curved flanges 66, 68 which project outward from the rear of rail assembly 12 and extend between each end thereof as shown in FIG. 2, FIG. 9, FIG. 11 and FIG. 13. Wall panel 14 typically includes panel ends 70 which include an aperture 72 with panel end lips 74, 76 extending out over the panel end apertures 72. Flanges 66, 68 fit behind panel end lips 74, 76 to securely attach rail assembly 12 to the end of the panel. Those skilled in the art will appreciate that this method of attachment is exemplary only, and that other conventional fastening means could be employed such as nut and bolt arrangements, nails, clips, tacks, clamps, solders, welds, adhesives and the like. It is also contemplated that a panel component could be fabricated with the elongated rail assembly 12 as an integral portion of the panel component.

Referring to FIG. 2, FIG. 3 and FIG. 7, in order to effect a connection between a hinge and rail, first inner rail flange 62 and first outer rail flange 58 of rail assembly 12 engage first and second channels 28 and 30, respectively, of rail coupling 16*a* in a first hinge 10. Similarly, second inner rail flange 64 and second outer rail flange 60 engage the first and second channels 28 and 30, respectively, of rail coupling 16*b* of a second hinge 10. Ridges 34 in the first and second channels 28 and 30 provide frictional traction to enhance connection integrity, and the tapered ends 36 of ridges 34 allow facile engagement and disengagement of the outer and inner rail flanges 58, 60, 62 and 64. Thus, one rail assembly 12 is attached to two hinges 10.

Figure 14:
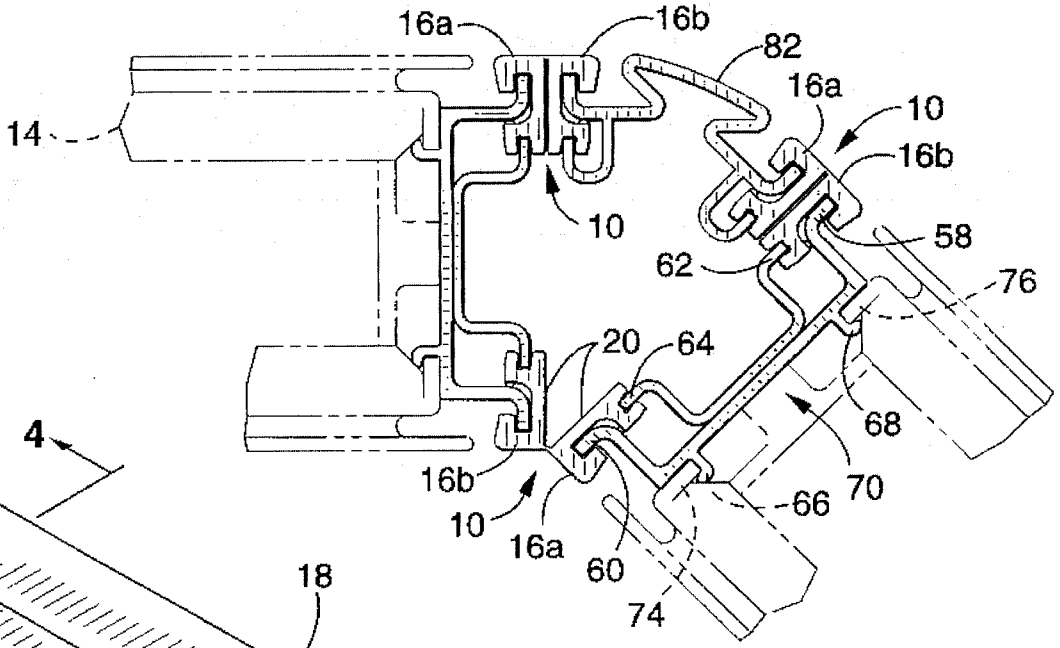
FIG. 14 is a plan view showing the present invention connecting the ends of two wall panels depicted in phantom in an elbow-shaped configuration.
Figure 10:
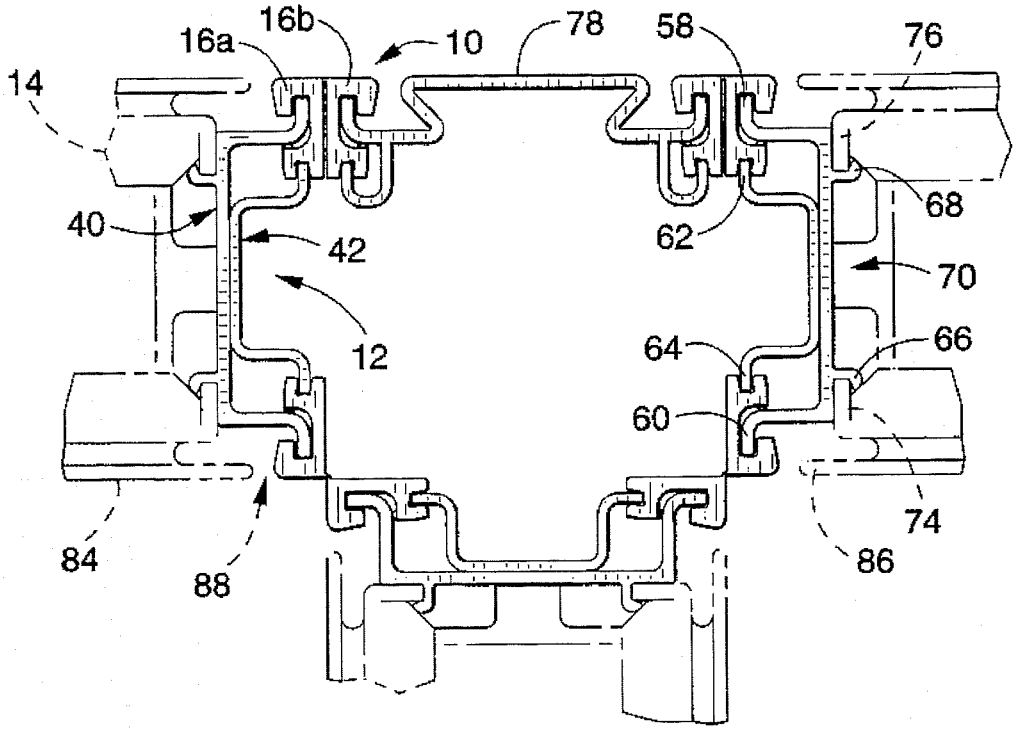
FIG. 10 is a perspective view showing the present invention connecting the ends of three wall panels depicted in phantom in a T-shaped configuration.
Figure 11:
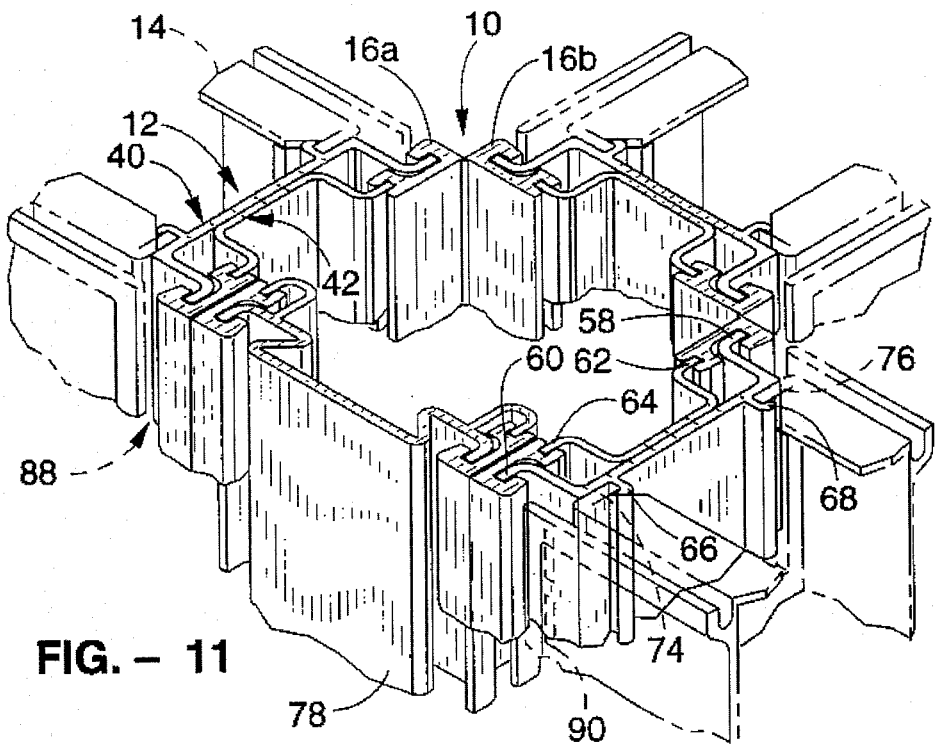
FIG. 11 is a plan view of the wall panel connection shown in FIG. 10.
Figure 12:
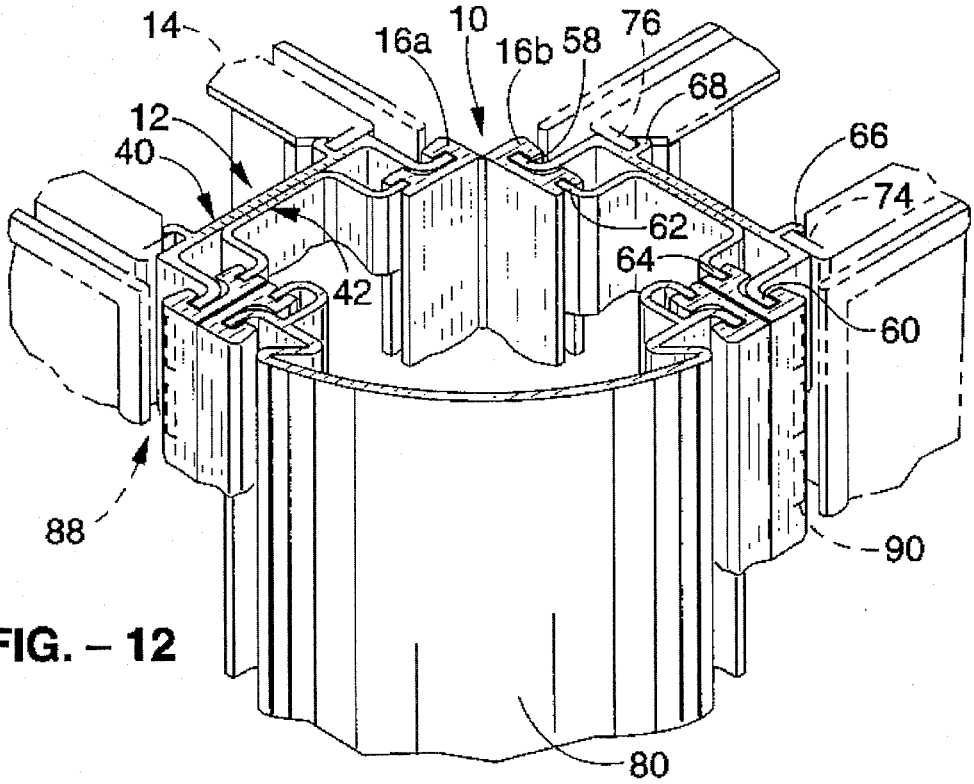
FIG. 12 is a perspective view showing the present invention connecting the ends of two wall panels depicted in phantom in a right angle configuration.
Figure 13:
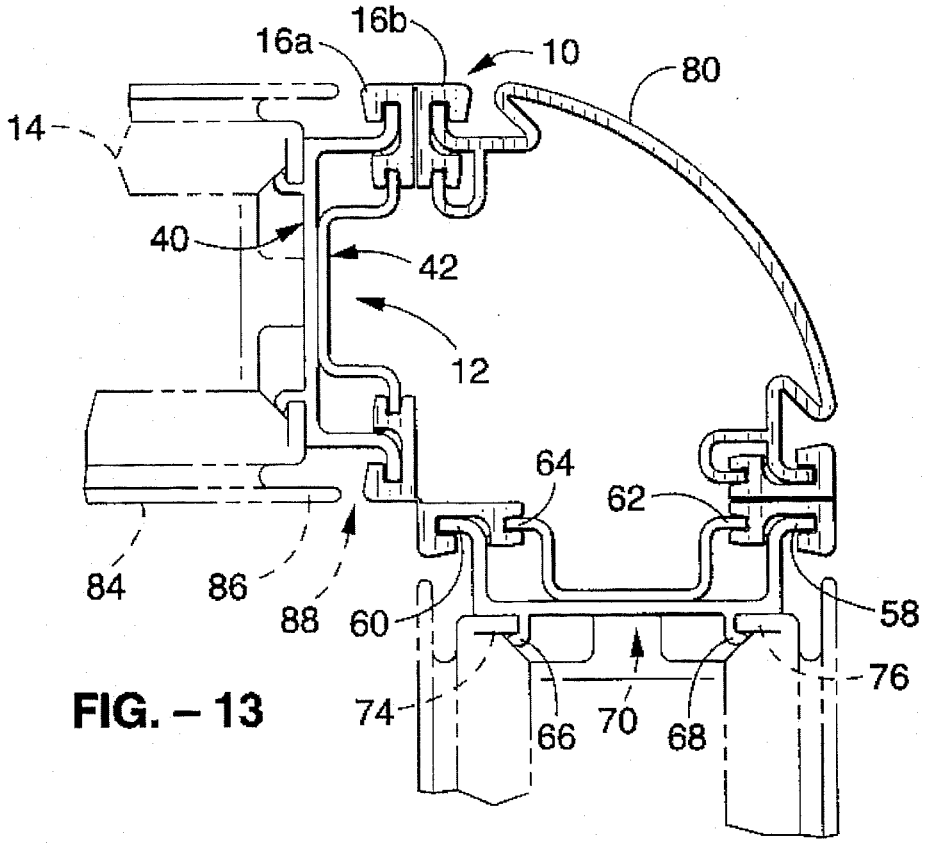
FIG. 13 is a plan view of the wall panel connection shown in FIG. 12.

Referring also to FIG. 8 through FIG. 14, depending on the angle of hinges 10 and the number of rail assemblies 12 involved, a number of possible connection configurations are possible. In FIG. 1 and FIG. 2, it was seen that two hinges 10 were used in their closed positions to couple the ends of two panels in a straight-line configuration. In FIG. 8 and FIG. 9, a cross configuration of four panels 14 is achieved by connecting four hinges 10 in their fully open position (ninety-degrees articulation) to four rails assemblies 12. In FIG. 10 and FIG. 11, a "T" configuration of three panels 14 is achieved by connecting four hinges 10, two of which are in their fully open position connecting three rail assemblies 12 on three panels 14. Two flexible hinge members 10 in their closed position connect two rail assemblies 12 and a cover rail 78, thus closing the "T" configuration and visually hiding the connecting surfaces. As shown in FIG. 10 and FIG. 11, cover rail 78 is configured as a flattened trapezoidal shape to achieve the visual hiding of the connecting surfaces. In FIG. 12 and FIG. 13, a right angle configuration of two panels 14 is achieved by connecting three hinges 10, one of which is in its fully open position connecting two rail assemblies 12 on two panels, and two of which are in their fully closed position connecting two rail assemblies 12 and a cover rail 80. As shown in FIG. 12 and FIG. 13, cover rail 80 is shaped as a sweeping right angle curve and is configured to close the right angle and to visually hide the connecting surfaces. FIG. 14 shows a connection system similar to that shown in FIG. 12 and FIG. 13. Here, however, one of the hinges 10 is open to forty-five degrees, and a forty-five degree curved cover rail 82 is used rather than a right angle sweep, thereby creating a panel connection with an elbow configuration. By curving the cover rail to any desired angle, a large number of hinge and rail connection configurations can thus be achieved to accommodate virtually any shape of work space desired.

Referring again to FIG. 1 and FIG. 2, in order to improve the visual aesthetics of the hinge and rail connection system, panel wall surfaces 84 preferably have panel wall surface extensions 86. Panel wall surface extensions 86 visually hide the outer rails by extending toward hinges 10. If desired, instead of making panel wall surface extensions 86 flush with hinges 10, a space 88 can be left for attaching hang-on type support brackets used in connecting components such as work surfaces, shelves, desks, file cabinets, and the like to the wall panels. In that configuration, outer rails 44, 46 would include a plurality of vertically aligned slots 90 located between their ends for receiving the hang-on type support brackets.

Preferably, hinge 10 is made of molded or extruded engineering plastic which is flexible so that installation of hinge 10 on rail assembly 12 does not require excessive force. Installation is effected by positioning the wall panels such that the rails are aligned for coupling and sliding hinge 10 along the length of the rails. The inner sides of the channels will spread open to receive the rails and ridges 34 will provide secure frictional engagement. Reversal of the process permits hinge 10 to be removed and the wall panels separated. Rail assembly 12 is preferably made of molded or extruded aluminum or other metal or metal alloy that is rigid and will not twist or bend during installation of hinge 10. However, use of man made or natural polymers or composites thereof, for fabricating rail assembly 12, are also contemplated.

It will be appreciated that the hinge 10 of the present invention can be colored to match that of the wall panels. Further, because the rails 44, 46, 48, and 50 are sandwiched into channels 28, 30, the rails are obscured from view. By coloring the rail members 40, 42 black, the exposed portions of the rails will be further obscured from view due when recessed into the wall panels. It will further be appreciated that rails 44, 46, 48 and 50, as well as channels 28, 30 could be of various shapes without departing from the scope of the invention disclosed herein, provided that the hinge includes channels for receiving the rails rather than the rails including channels for receiving the hinge. In this way, the rails will remain obscured from view. Additionally, if desired, rail member 42 could be eliminated without significantly altering the structural integrity of the wall panel connection achieved by means of the present invention.

Accordingly, it will be seen that this invention provide a hinge and rail connection system which permits two or more wall panels to be joined in a variety of configurations, while providing a dramatically improved aesthetic appearance for this type of connection by sandwiching the rails in the channels of the rail couplings. Although the description above contains many specificities, these should not be construed as limiting the scope of the invention but as merely providing illustrations of some of the presently preferred embodiments of this invention: Thus the scope of this invention should be determined by the appended claims and their legal equivalents.

I claim:

1. An apparatus for connecting wall panels, comprising:

(a) an elongated rail assembly, said rail assembly having first and second ends, said rail assembly including first and second outer rails extending between said first and second ends, and first and second inner rails extending between said first and second ends; and (b) an elongated hinge, said hinge having first and second ends, said hinge including a plurality of symmetrical rail couplings extending between said first and second ends, each said rail coupling including first channel means for receiving at least one said rail, each said rail coupling including second channel means for receiving at least one said rail, said first and second channel means extending between said first and second ends, said rail couplings pivotally connected along a shared edge.

2. An apparatus as recited in claim 1, further comprising means for coupling said rail assembly to a wall panel.

3. An apparatus as recited in claim 2, wherein said means for coupling said rail assembly to a wall panel comprises a plurality of elongated flanges joined to and extending from said rail assembly.

4. An apparatus as recited in claim 1, wherein said first and second outer rails and said first and second inner rails are symmetrical.

5. An apparatus as recited in claim 1, wherein said channel means includes traction means for frictionally engaging a rail received by said channel means.

6. An apparatus as recited in claim 5, wherein said traction means comprises a longitudinal ridge contained within said channel means.

7. An apparatus for detachably coupling ends of adjoining modular wall panels, comprising:

(a) an elongated rail assembly, said rail assembly having first and second ends, said rail assembly including symmetrical first and second outer rails extending between said first and second ends, said rail assembly including first and second inner rails extending between said first and second ends; and (b) an elongated hinge, said hinge having first and second ends, said hinge including opposing pivotally connected rail couplings extending between said first and second ends, each said rail coupling including first channel means for receiving a said one of said outer rails, each said rail coupling including second channel means for receiving a said one of said inner rails.

8. An apparatus as recited in claim 7, wherein each said rail coupling includes a first side, a second side, a third side, and a fourth side, each said third side of said rail coupling including said first channel means, each said fourth side of said rail coupling including said second channel means.

9. An apparatus as recited in claim 8, said rail assembly including a face, each said rail extending from said face in a substantially perpendicular orientation, each said rail including a flange, said first and second inner rails positioned between said outer rails in a substantially parallel orientation.

10. An apparatus as recited in claim 9, further comprising means for coupling said rail assembly to a wall panel.

* * * * *